US006716143B1

(12) United States Patent
Martin

(10) Patent No.: US 6,716,143 B1
(45) Date of Patent: Apr. 6, 2004

(54) WHEELCHAIR EXERCISING SYSTEM

(76) Inventor: Wallace Kent Martin, 1221 Sarasota Dr., Tallahassee, FL (US) 32301-5728

( * ) Notice: Subject to any disclaimer, the term of this patent is extended or adjusted under 35 U.S.C. 154(b) by 0 days.

(21) Appl. No.: 10/392,221

(22) Filed: Mar. 20, 2003

(51) Int. Cl.[7] ..... A63B 21/00
(52) U.S. Cl. ..... 482/92; 482/94; 482/62
(58) Field of Search ..... 482/92, 904, 62, 482/45, 138, 142, 51; 601/33, 36, 23

(56) References Cited

U.S. PATENT DOCUMENTS

| | | | | |
|---|---|---|---|---|
| 3,423,086 | A | | 1/1969 | Moore |
| 4,153,244 | A | | 5/1979 | Tauber, Jr. |
| 4,747,595 | A | | 5/1988 | Mabry et al. |
| 4,765,614 | A | | 8/1988 | Shute |
| 4,911,425 | A | | 3/1990 | Kynast et al. |
| 4,966,362 | A | | 10/1990 | Ramaekers |
| 4,993,732 | A | | 2/1991 | Wedemeyer |
| 5,066,032 | A | | 11/1991 | Van Vooren et al. |
| 5,100,128 | A | | 3/1992 | Mabry et al. |
| 5,324,060 | A | | 6/1994 | Van Vooren et al. |
| 5,476,429 | A | | 12/1995 | Bigelow et al. |
| 5,536,228 | A | | 7/1996 | Tanner, Jr. |
| 5,643,143 | A | * | 7/1997 | Burak et al. |
| 5,704,876 | A | | 1/1998 | Baatz |
| 5,709,631 | A | | 1/1998 | Kleinsasser |
| 5,762,593 | A | | 6/1998 | Whiteley |
| 5,839,995 | A | * | 11/1998 | Chen |
| 6,036,623 | A | | 3/2000 | Mitchell |
| 6,113,519 | A | | 9/2000 | Goto |
| 6,196,565 | B1 | | 3/2001 | Chubbuck |
| 6,220,615 | B1 | | 4/2001 | Chubbuck |
| 6,220,992 | B1 | * | 4/2001 | Shafik |

* cited by examiner

*Primary Examiner*—Jerome W. Donnelly
(74) *Attorney, Agent, or Firm*—Peter Loffler

(57) ABSTRACT

An exercising system for use by wheelchair bound users, uses a platform that has a pair of rollers on which the user can stationarily roll the wheelchair. A first pulley allows the user to perform reciprocating up and down rope and pulley exercises, while a pair of foot pedals allow for lower body exercising. The foot pedals can be attached to the platform and can have a rope over a pulley assist mechanism or the foot pedals can be attached directly to the wheelchair and can operate independently of the platform. A punching bag or other similar item can be attached to the exercising system in order to increase the range of physical activities that can be performed by a user.

22 Claims, 4 Drawing Sheets

WHEELCHAIR EXERCISING SYSTEM

BACKGROUND OF THE INVENTION

1. Field of the Invention

The present invention relates to a system that allows a user who is wheelchair bound to be able to perform a variety of exercises, both upper body and lower body exercises and both aerobic and anaerobic exercises, all without the need to leave the wheelchair.

2. Background of the Prior Art

People become wheelchair bound for a variety of reasons. A sudden lower body injury from a sporting event or an accident, a debilitating disease, and recovery from surgery are all reasons that people use wheelchairs. Some people, such as those who break one or both legs in a skiing accident, for example, are in the wheelchair for a relatively short period of time while their bodies heal. Others, such as those that receive a spinal cord injury, spend substantially longer in the wheelchair and may even spend the rest of their lives being wheelchair bound.

After the shock of being wheelchair bound wears off, most wheelchair uses share a common trait. They view their situation with regard to the wheelchair not as a limitation on their abilities as humans, but rather as the wheelchair being just one more of life's obstacles to be overcome. Such people, owing to the strength and resiliency of the human spirit, adapt to their new wheelchair environment and otherwise attack life like before and such people do not let the wheelchair stand in their way of achieving their goals.

One important aspect of life that wheelchair bound people quickly learn to appreciate, is that despite the fact that they spend a large portion of the day in the wheelchair in a sitting position, their bodies need to exercise on a regular basis. They need to kept their bodies in shape just like everyone else. Even a paraplegic needs to keep the muscles in the legs toned despite the inability to feel the legs. The wheelchair bound person also learns that the wheelchair is not a limitation on exercising, only that the wheelchair simply modifies the manner in which exercising is performed. The person recognizes that any muscle group that a normally ambulatory person can exercise, both aerobic and anaerobic, the wheelchair bound person can also exercise, albeit with some modification.

Toward this end, many devices have been proposed that allow a person to remain within a wheelchair and to perform exercises of all types directly from the wheelchair in order to allow the person to stay in shape. Some such devices, which work with varying degrees of efficiency, tend to be unduly complex in design making such devices relatively expensive to manufacture and thus less affordable. Other such devices tend to be unduly difficult to assemble and use making the user frustrated with the potential for the user to give up exercising. Still other devices, although relatively simple in design and construction and relatively easy to assemble and use, are limited in that they exercise only a small portion of the user's body. A user needs to purchase several varying devices and move from device to device in order to achieve a full workout. While some users may not object to such an arrangement, others will find it a difficult solution due to the costs of having to purchase several pieces of equipment, the large storage needs of the several pieces and, if the person needs help assembling and disassembling the equipment to be used, the need to have another person present during the entire workout.

Therefore, there exists a need in the art for a system that allows a wheelchair bound person to achieve a robust full body workout and which addresses the above stated problems found in the art. Such a system must be relatively simple in design and construction so that the system can be relatively inexpensively manufactured using standard manufacturing techniques and so that the system is relatively easy to assemble, install and use. Such a system must provide the user with a large variety of exercises, for both the upper body and the lower body, and both aerobic and anaerobic, to allow the user to exercise all desired muscle groups without the need for a large number of devices. Such a system should allow the user to switch between exercises without the need for an additional person to be present so as to allow the user the ability to go through an exercise session unassisted. Ideally, such a system will be comfortable and natural for the person to use.

SUMMARY OF THE INVENTION

The wheelchair exercising system of the present invention addresses the aforementioned needs in the art. The wheelchair exercising system allows a wheelchair bound person to achieve a robust full body workout, offering a wide variety of exercises, both upper body and lower body exercises as well as both aerobic and anaerobic exercises so that the user can exercise all desired muscle groups. The wheelchair exercising system is relatively simple in design and construction making the system relatively inexpensive to manufacture using standard manufacturing techniques. The wheelchair exercising system is relatively easy to assemble, install and use. The wheelchair exercising system of the present invention allows the user to quickly and easily switch between exercises without the need for an additional person to be present thereby allowing the user the ability to go through an exercise session unassisted. The wheelchair exercising system is comfortable and natural for the person to use.

The wheelchair exercising system of the present invention is comprised of a platform that has a ramped leading edge and a trailing edge. A pair of generally coextensive rollers are attached to the platform proximate the trailing edge. A first stanchion is attached to the platform proximate the trailing edge and has an extension arm that extends outwardly toward the leading edge. A first pulley is attached to the extension. A first rope is slidably positioned over the first pulley, the first rope having a first end and a second end. A first handle is attached to the first end of the first rope while a second handle is attached to the second end of the first rope. A wheelchair is positioned on the platform via the leading edge, such that a pair of the rear wheels of the wheelchair are received on the pair of rollers and drive the rollers through the rotation of the rear wheels of the wheelchair. The first rope is slidable up and down along the first pulley through alternating up and down pulling on the first handle and the second handle. A table is attached to the platform. A tensioning rod is threadably attached to a bracket located on the platform such that rotation of the tensioning rod causes the tensioning rod to contact one of the rollers and thereby frictionally increase the rolling resistance of that roller. At least one stowage hook is attached to the first stanchion. The first pulley is attached to the extension by providing the first pulley with a first quick release clip which first clip is received within a first eyelet located on the extension. A second eyelet is located on the extension in spaced apart fashion relative to the first eyelet. A punching bag is removably attachable to one of the first eyelet or the second eyelet by providing the punching bag with a clip that attaches to one of the eyelets. A pair of foot pedals are attached to the platform proximate the leading edge. A second pulley is attached to the extension while a second rope is slidably positioned over the second pulley, the second rope having a third end attached to one of the pair of the foot pedals, and a fourth end attached to the other of the pair of foot pedals, such that the pair of foot pedals are in offset relation with each other. A third handle is attached to the second rope between the second pulley and one of the pair of foot pedals while a fourth handle is attached to the second rope between the second pulley and the other of the pair of foot pedals. A pair of wheels is attached to a first side of the platform while a handle is attached to an opposing second side of the platform. A bar is attached to the platform and coextensively extends between the rollers, while a lock is slidably disposed on the bar for holding the wheelchair in lateral alignment on the pair of rollers. A bracket is attachable to the wheelchair, the bracket having a second stanchion. The pair of foot pedals are attached to the bracket, a third pulley is attached to the stanchion, and a third rope is slidably positioned over the third pulley, the third rope having a fifth end attached to one of the pair of the foot pedals, and a sixth end attached to the other of the pair of foot pedals in order for the pair of foot pedals to be in offset relation with each other.

BRIEF DESCRIPTION OF THE DRAWINGS

Similar reference numerals refer to similar parts throughout the several views of the drawings.

DESCRIPTION OF THE PREFERRED EMBODIMENT

Figure 1:
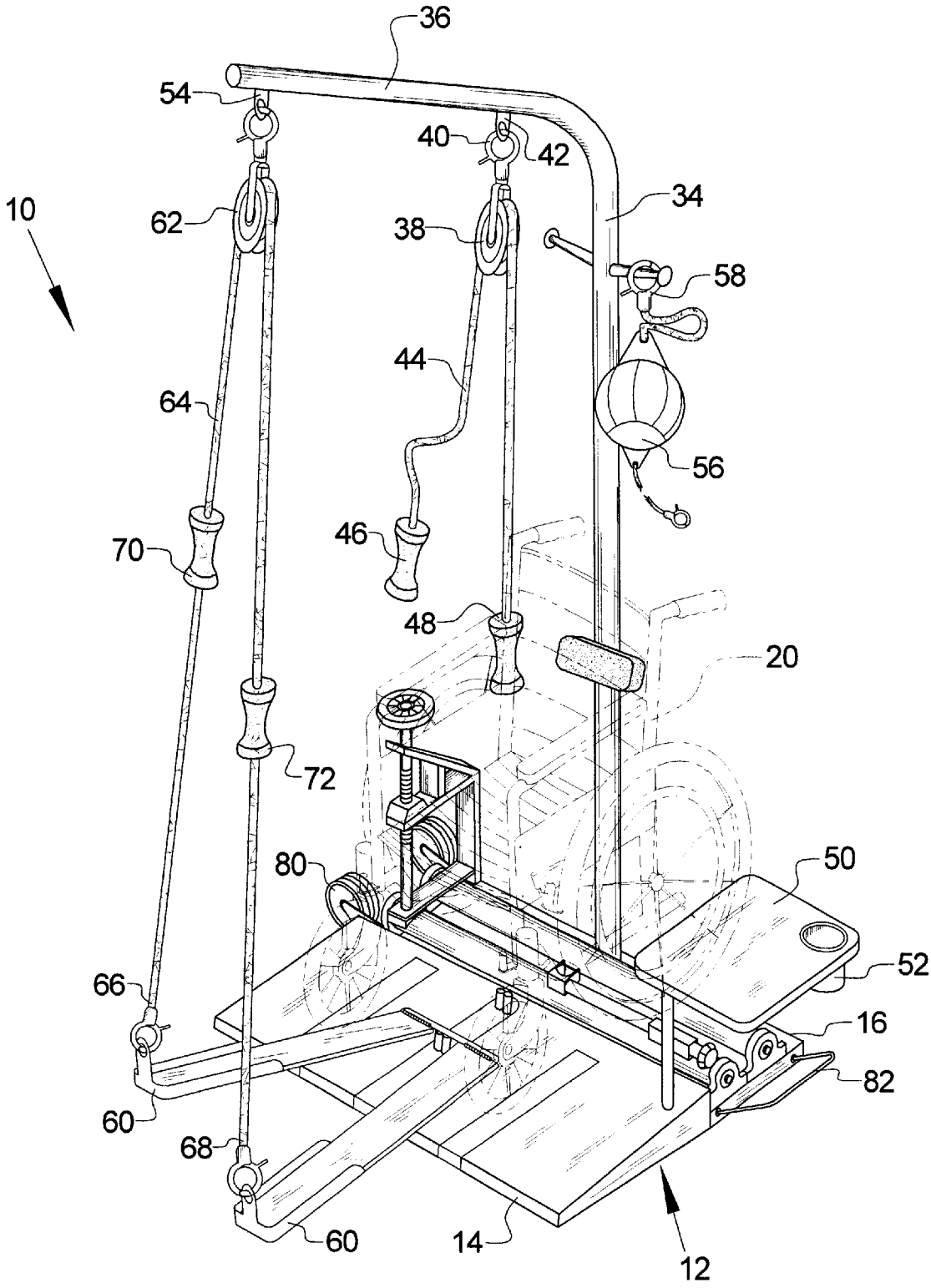
FIG. 1 is an environmental view of the wheelchair exercising system of the present invention.
Figure 2:
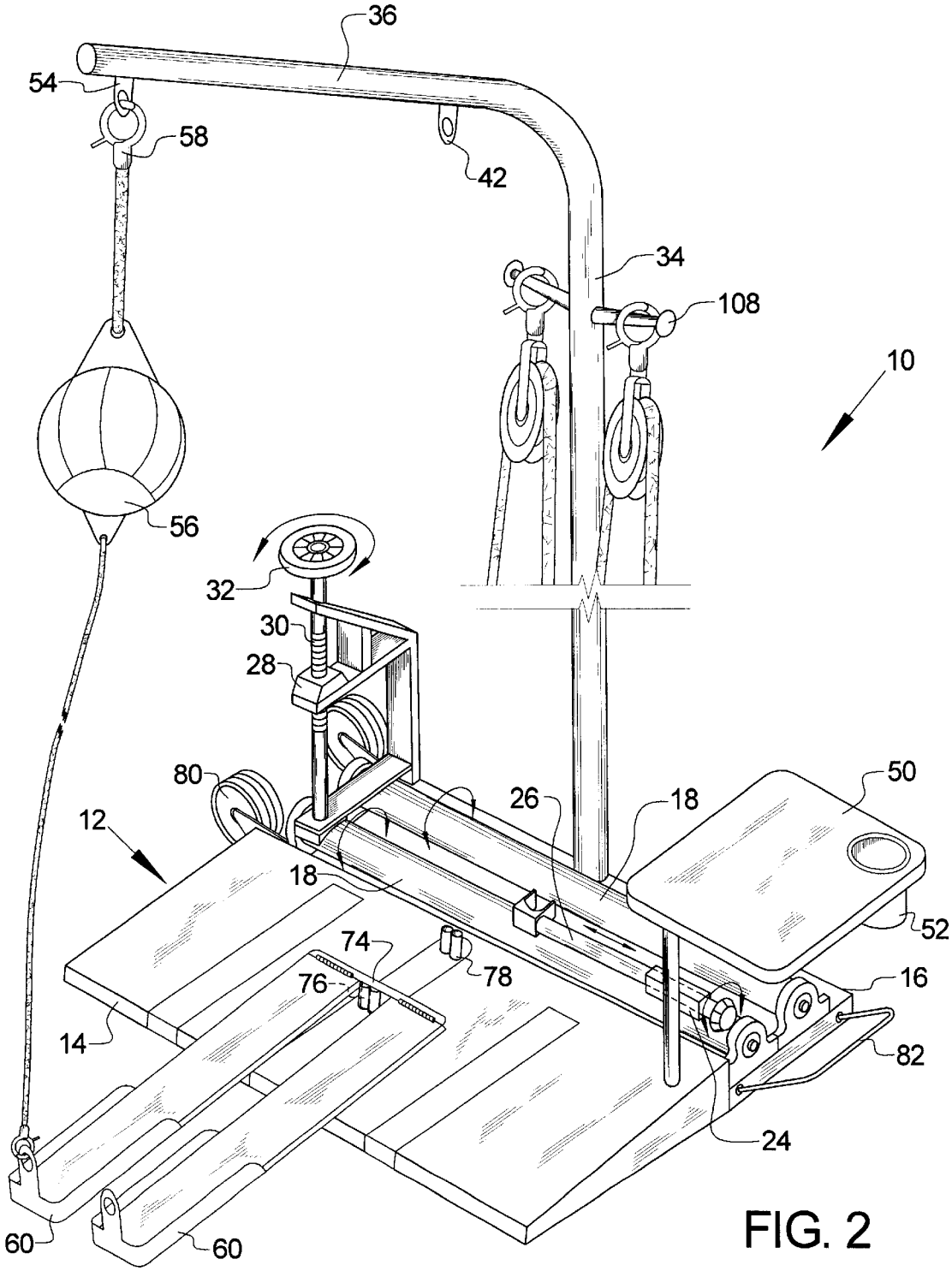
FIG. 2 is a close-up view of the main platform of the wheelchair exercising system.
Figure 3:
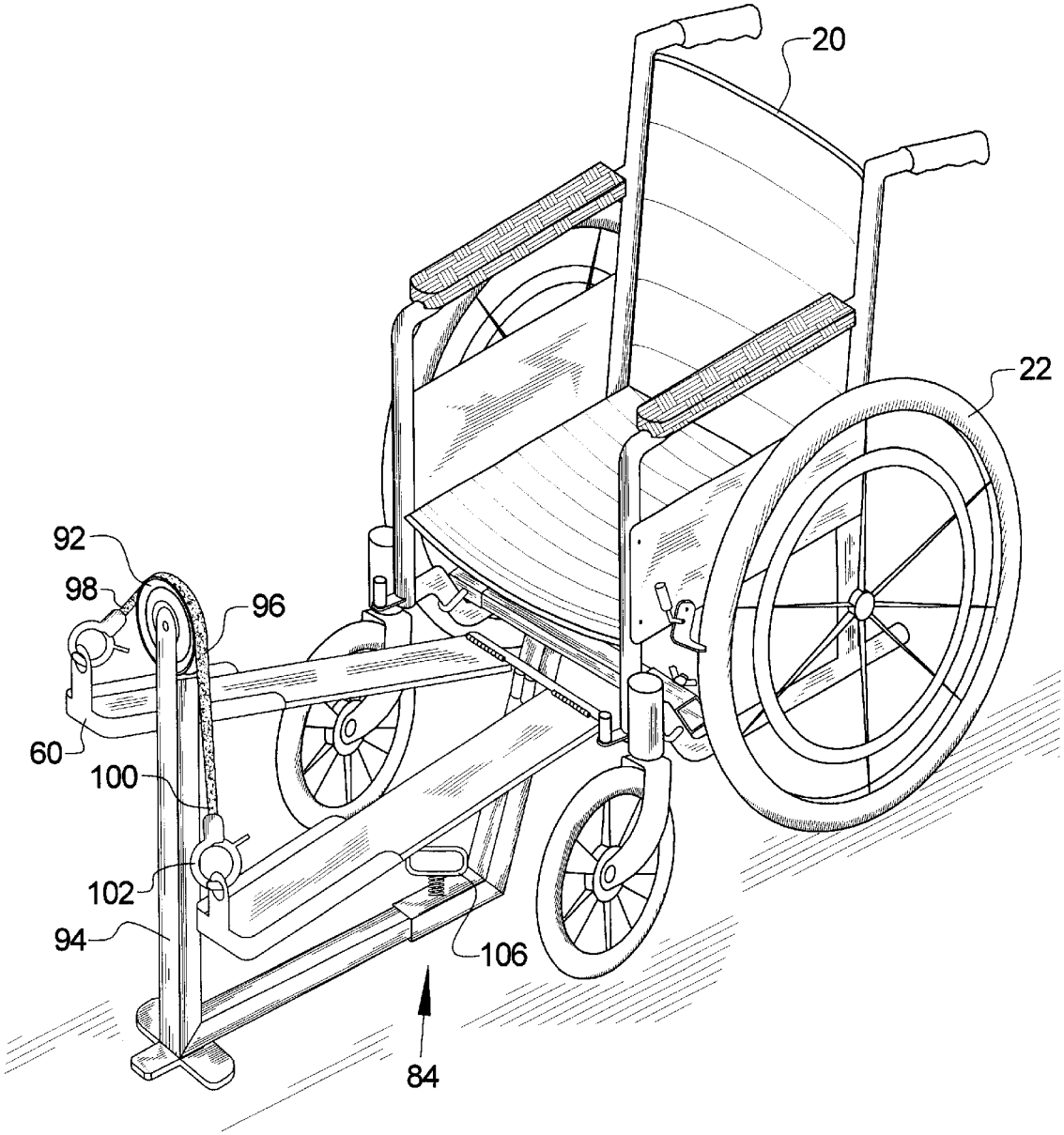
FIG. 3 is an environmental view of the auxiliary leg exerciser of the wheelchair exercising system of the present invention.
Figure 4:
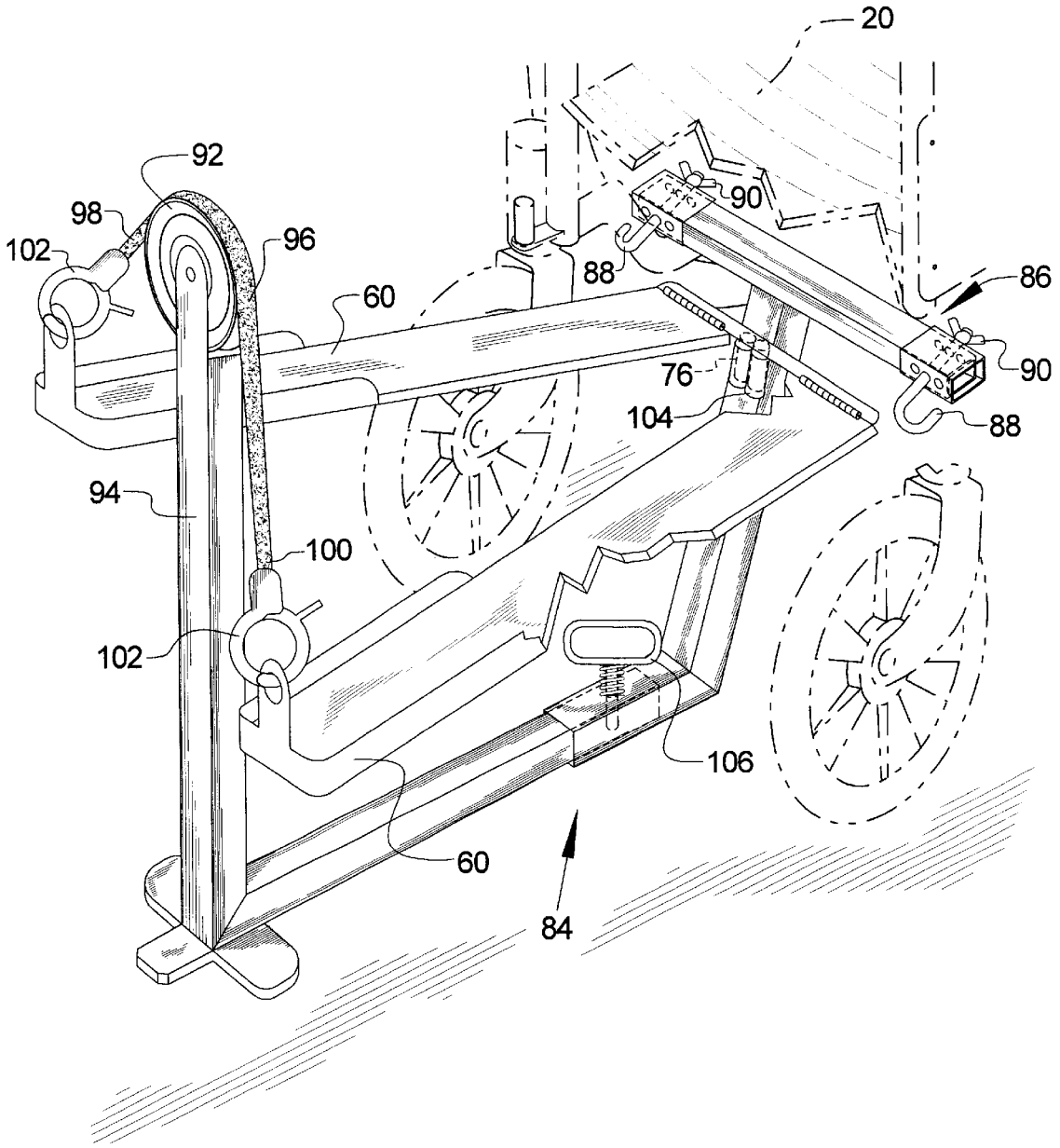
FIG. 4 is a close-up view of the auxiliary leg exerciser.

Referring now to the drawings, it is seen that the wheelchair exercising system of the present invention, generally denoted by reference numeral 10, is comprised of a platform 12 that has a ramped leading edge 14 and a trailing edge 16. A pair of generally coextensive rollers 18 are rotatably attached to the platform 12 proximate the trailing edge 16. A wheelchair 20 ascends the platform 12 backwards until the rear wheels 22 of the wheelchair 20 are received between the pair of rollers 18 located on the platform 12. Once so positioned, the wheelchair 20 is held in lateral alignment on the pair of rollers 18 by the use of a locking system which comprises a bar 24 that is attached to the platform 12 and located between the pair of rollers 18 in generally parallel orientation with the rollers 18 and a sliding lock 26 slidably located on the bar 24 such that once the wheelchair is in a desired position on the platform 12, the lock 26 is slid along the bar 24 until the lock 26 engages one of the wheels 22 of the wheelchair 20 wherein the lock 26 is locked in place to the bar 24 in order to hold the wheelchair 20 in the desired position. The locking mechanism on the lock 26 is of any conventional system that locks a collar to a bar known in the art. A user of the device 10 sits in the wheelchair 20 and rotates the rear wheels 22 of the wheelchair 20 in order to exercise. The rollers 18 allow the rear wheels 22 of the wheelchair 20 to rotate without the wheelchair 20 moving from the platform 12. The user can exercise in this fashion as long as desired.

If desired, the rolling resistance on of the rollers 18 can be increased. This is accomplished by providing a bracket 28 that has a threaded screw 30 passing therethrough. The end of the threaded screw is positioned proximate one of the rollers 18 such that by rotation of the screw 30, the end of the screw 30 frictionally engages the roller 18 causing the rolling resistance to increase thereby requiring the user to work harder to achieve a given level of wheelchair wheel 22 rotation. Further rotation of the screw 30 further increases the rolling resistance of that roller 18. Counterrotation of the screw 30 decreases contact of the screw 30 with the roller 18 and thus decreases the rolling resistance of the roller 18 until the screw 30 completely disengages from the roller 18 whereat the roller 18 has the minimum rolling resistance. An appropriate handle 32 can be attached to the opposing end of the screw 30 to assist the user in rotating and counterrotating the screw 30.

A first stanchion 34 is attached to the platform 12 proximate the trailing edge 16 and has an extension arm 36 that extends outwardly toward the leading edge 14 and which may be telescoping. A first pulley 38 is attached to the extension 36, the first pulley 38 having a quick release clip 40 thereon that attaches to a first eyelet 42 located on the extension 36. A first rope 44 is slidably positioned over the first pulley 38, the first rope 44 having a first end and a second end. A first handle 46 is attached to the first end of the first rope 44 while a second handle 48 is attached to the second end of the first rope 44. A user sitting in a wheelchair 20 that is positioned on the platform 12 can grasp the first rope 44, one hand on each of the handles 46 and 48 and slide the first rope 44 up and down along the first pulley 38 by pulling up and down on the pair of handles 46 and 48 in reciprocating fashion in order to achieve an upper body workout.

A table 50 is attached to the platform 12 for holding various items desired by the user of the device, the table having a drink holder 52 thereon.

A second eyelet 54 is located on the extension 36 in spaced apart fashion relative to the first eyelet 42. A punching bag 56 can be removably attached to one of the first eyelet 42 or the second eyelet 54, the punching bag 56 having an appropriate quick release clip 58 thereon for attachment to one of the eyelets 42 or 54. The punching bag 56 is also tethered to the platform 12.

A pair of foot pedals 60 is attached to the platform 12 proximate the leading edge 14. A second pulley 62 is attached to the second eyelet 54 of the extension 36 while a second rope 64 is slidably positioned over the second pulley 62, the second rope 64 having a third end 66 attached to one of the pair of the foot pedals 60, and a fourth end 68 attached to the other of the pair of foot pedals 60, such that the pair of foot pedals 60 are in offset relation with each other. A user sitting in a wheelchair 20 positioned on the platform 12 can place each foot onto a respective one of the first foot pedals 60 and can reciprocate the foot pedals 60 up and down in order to receive a lower body workout. If desired, third handle 70 is attached to the second rope 64 between the second pulley 62 and one of the pair of foot pedals 60 while a fourth handle 72 is attached to the second rope 64 between the second pulley 62 and the other of the pair of foot pedals 60. If the user lacks the requisite lower body strenght, the user can use grasp the third handle 70 and the fourth handle 72 and help move the foot pedals 60 up and down with arm strength. The pair of foot pedals 60 is attached to a bracket 74 which is attached to the platform 12 by having pins 76 which are receivable within corresponding sockets 78 located on the platform 12. Multiple sockets 78 can be located on the platform 12 for size adjusting the pedals 60 with respect to a user positioned in a wheelchair 20 itself positioned on the platform 12 such that the user positions the pins 76 of the bracket 74 within the sockets 78 that are the desired distance from the wheelchair 20 positioned on the platform 12.

In order to facilitate transport of the wheelchair exercising system 10, pair of wheels 80 is attached to a first side of the platform 12 while a handle 82 is attached to an opposing second side of the platform 12. A person can grasp the handle 82 and lift up and roll the platform 12 to a desired location.

A bracket 84 may be attached to the wheelchair 20. The bracket 84 is attached to the wheelchair 20 by providing an adjustable width collar 86 that has a pair of U-bolts 88 thereon which are tightened by appropriate wing nuts 90. The collar 86 is extended to desired width and the U-bolts 88 engage appropriate portions of the wheelchair 20 wherein the wing nuts 90 are tightened to hold the collar 86 thereat. A pair of foot pedals 60 is pivotally attached to this bracket 84 while a third pulley 92 is attached to a second stanchion 94. A third rope 96 is slidably positioned over the third pulley 92, the third rope 96, having a fifth end 98 attached to one of the pair of foot pedals 60, and a sixth end 100 attached to the other of the pair of foot pedals 60 by appropriate clips 102, such that the pair of foot pedals 60 are in offset relation with each other. The pedals 60 are attached to the bracket 84 by having the pins 76 of the foot pedals being removably received within sockets 104 on the bracket 84.

A user of the device can gain a lower body workout by using the foot pedals 60 in similar fashion to the use of the foot pedals 60 on the platform 12, with the exception that in this configuration the foot pedals 60 lack the rope assist capability. For ease of transport of the wheelchair 20 while the bracket 84 is attached, and for ease of transport of this subsystem, the second stanchion 94 can be attached to the remainder of the bracket 84 by an appropriate quick release handle 106 such that the bracket 84 of two sections, the first section being attached to the wheelchair 20 and the second section holding the stanchion 94 and pulley 92. The two sections are brought together and the quick release handle 106 secures the two sections together. Pulling on the handle 106 allows the two sections to be separated.

Stowage hooks 108 may be located on the first stanchion 34 in order to hold the various ropes and other accessories when such items are not in use.

While the invention has been particularly shown and described with reference to an embodiment thereof, it will be appreciated by those skilled in the art that various changes in form and detail may be made without departing from the spirit and scope of the invention.

I claim:

1. An exercising system comprising:

a platform having a ramped leading edge and a trailing edge;

a pair of generally coextensive rollers attached to the platform proximate the trailing edge;

a first stanchion attached to the platform proximate the trailing edge and having an extension arm that extends outwardly toward the leading edge;

a first pulley attached to the extension;

a first rope slidably positioned over the first pulley, the first rope having a first end and a second end;

a first handle attached to the first end of the first rope;

a second handle attached to the second end of the first rope; and wherein a wheelchair is positioned on the platform via the leading edge, such that a pair of rear wheels of the wheelchair are received on the pair of rollers and drive the rollers through the rotation of the rear wheels and first rope is slidable up and down along the first pulley through alternate up and down pulling on the first handle and the second handle.

2. The exercising system as in claim 1 further comprising a table attached to the platform.

3. The exercising system as in claim 1 further comprising a tensioning rod threadably attached to a bracket of the platform such that rotation of the tensioning rod causes the tensioning rod to contact one of the rollers and thereby frictionally increase the rolling resistance of that roller.

4. The exercising system as in claim 1 further comprising at least one stowage hook attached to the first stanchion.

5. The exercising system as in claim 1 wherein the first pulley is attached to the extension by providing the first pulley with a first clip which first clip is received within a first eyelet located on the extension.

6. The exercising system as in claim 5 further comprising a second eyelet located on the extension in spaced apart fashion relative to the first eyelet.

7. The exercising system as in claim 6 further comprising a punching bag that is removably attachable to one of the first eyelet or the second eyelet.

8. The exercising system as in claim 1 further comprising:

a pair of foot pedals pivotally attached to the platform proximate the leading edge;

a second pulley attached to the extension; and a second rope slidably positioned over the second pulley, the second rope having a third end attached to one of the pair of the foot pedals, and a fourth end attached to the other of the pair of foot pedals, such that the pair of foot pedals are in offset relation with each other.

9. The exercising system as in claim 8 further comprising:

a third handle attached to the second rope between the second pulley and one of the pair of foot pedals; and a fourth handle attached to the second rope between the second pulley and the other of the pair of foot pedals.

10. The exercising system as in claim 1 further comprising:

a pair of wheels attached to a first side of the platform; and a handle attached to an opposing second side of the platform.

11. The exercising system as in claim 1 further comprising:

a bar attached to the platform and coextensively extending between the rollers;

and a lock slidably disposed on the bar for holding the wheelchair in lateral alignment on the pair of rollers.

12. The exercising system as in claim 1 further comprising:

a bracket attachable to the wheelchair, the bracket having a second stanchion;

a pair of foot pedals attached to the bracket;

a second pulley attached to the second stanchion; and a second rope slidably positioned over the second pulley, the second rope having a third end attached to one of the pair of the foot pedals, and a fourth end attached to the other of the pair of foot pedals, such that the pair of foot pedals are in offset relation with each other.

13. An exercising system comprising:

a platform having a ramped leading edge and a trailing edge;

a pair of generally coextensive rollers attached to the platform proximate the trailing edge;

a first stanchion attached to the platform proximate the trailing edge and having an extension arm that extends outwardly toward the leading edge;

a first pulley attached to the extension;

a pair of first foot pedals pivotally attached to the platform proximate the leading edge;

a first rope slidably positioned over the second pulley, the first rope having a first end attached to one of the pair of the foot pedals, and a second end attached to the other of the pair of foot pedals, such that the pair of foot pedals are in offset relation with each other and wherein a wheelchair is positioned on the platform via the leading edge, such that a pair of rear wheels of the wheelchair are received on the pair of rollers and drive the rollers through the rotation of the rear wheels.

14. The exercising system as in claim 13 further comprising:

a first handle attached to the first rope between the first pulley and one of the pair of foot pedals; and a second handle attached to the first rope between the first pulley and the other of the pair of foot pedals.

15. The exercising system as in claim 13 further comprising a table attached to the platform.

16. The exercising system as in claim 13 further comprising a tensioning rod threadably attached to a bracket of the platform such that rotation of the tensioning rod causes the tensioning rod to contact one of the rollers and thereby frictionally increase the rolling resistance of that roller.

17. The exercising system as in claim 13 further comprising at least one stowage hook attached to the first stanchion.

18. The exercising system as in claim 13 wherein the first pulley is attached to the extension by providing the first pulley with a clip which clip is received within an eyelet located on the extension.

19. The exercising system as in claim 18 further comprising a punching bag that is removably attachable to the eyelet.

20. The exercising system as in claim 13 further comprising:

a pair of wheels attached to a first side of the platform; and a handle attached to an opposing second side of the platform.

21. The exercising system as in claim 13 further comprising:

a bar attached to the platform and coextensively extending between the rollers;

and a lock slidably disposed on the bar for holding the wheelchair in lateral alignment on the pair of rollers.

22. The exercising system as in claim 1 further comprising:

a bracket attachable to the wheelchair, the bracket having a second stanchion;

a pair of second foot pedals attached to the bracket;

a second pulley attached to the stanchion; and a second rope slidably positioned over the second pulley, the second rope having a third end attached to one of the pair of the foot pedals, and a fourth end attached to the other of the pair of foot pedals, such that the pair of foot pedals are in offset relation with each other.

* * * * *